US005143354A

United States Patent [19]

Nolan

[11] Patent Number: 5,143,354

[45] Date of Patent: Sep. 1, 1992

[54] ANIMAL RETENTIVE FENCE ATTACHMENT

[76] Inventor: McEdward M. Nolan, 3420 Far Hill Cir., Birmingham, Ala. 35243

[21] Appl. No.: 751,504

[22] Filed: Aug. 29, 1991

[51] Int. Cl.[5] ..... E04H 17/00

[52] U.S. Cl. ..... 256/12; 256/16; 256/11

[58] Field of Search ..... 256/11, 12, 16

[56] References Cited

U.S. PATENT DOCUMENTS

| | | | |
|---|---|---|---|
| 321,171 | 6/1885 | Archibald | 256/12 |
| 1,140,171 | 5/1915 | Lawrie et al. | 256/16 |
| 3,084,913 | 4/1963 | Cox | 256/11 |
| 3,771,767 | 11/1973 | Dougherty | 256/11 |
| 3,806,095 | 4/1974 | Ford | 256/11 |
| 4,270,736 | 6/1981 | Burch | 256/12 |

*Primary Examiner*—Andrew V. Kundrat

*Attorney, Agent, or Firm*—Jennings, Carter, Thompson & Veal

[57] ABSTRACT

An attachment to a fence, such as a chain link fence, used to confine a dog, prevents the dog from climbing the fence or using the top of the fence to assist himself in escaping over the fence. The attachment creates a region of instability, superjacent the top of the fence, which will not support the dog's weight and thus does not allow the dog to cling to or push off of the top rail of the fence. The region of instability is created by a freely rotatable roller attachment or a flexible panel attachment, both of which yield under the weight of the canine.

6 Claims, 5 Drawing Sheets

FIG. 1
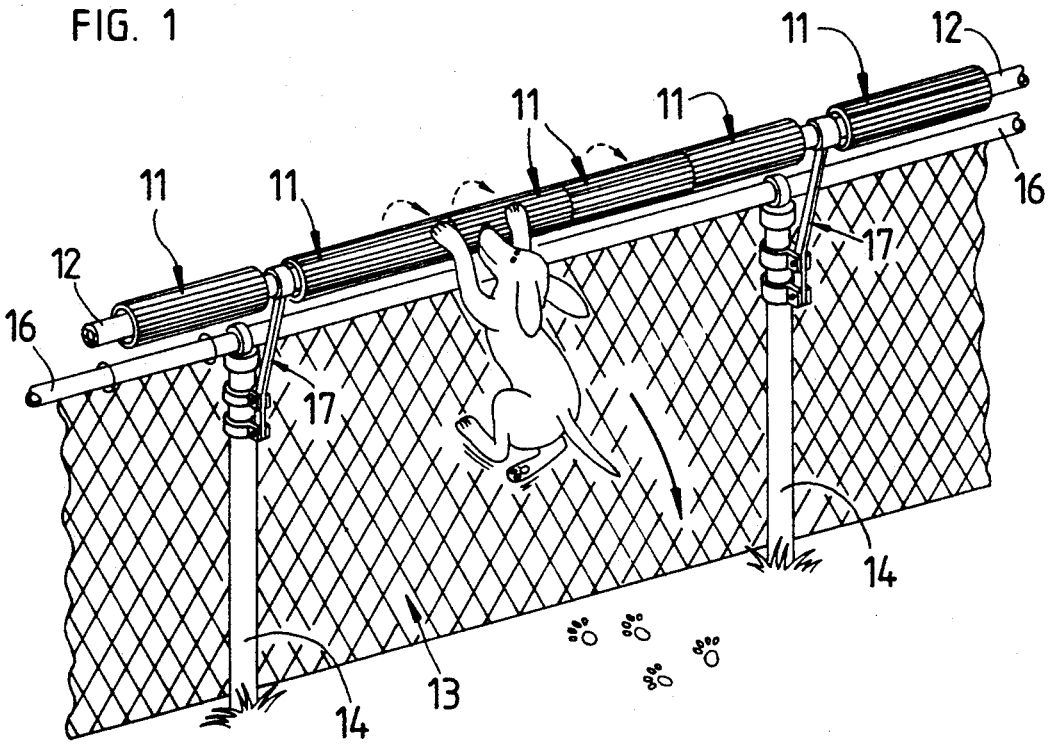
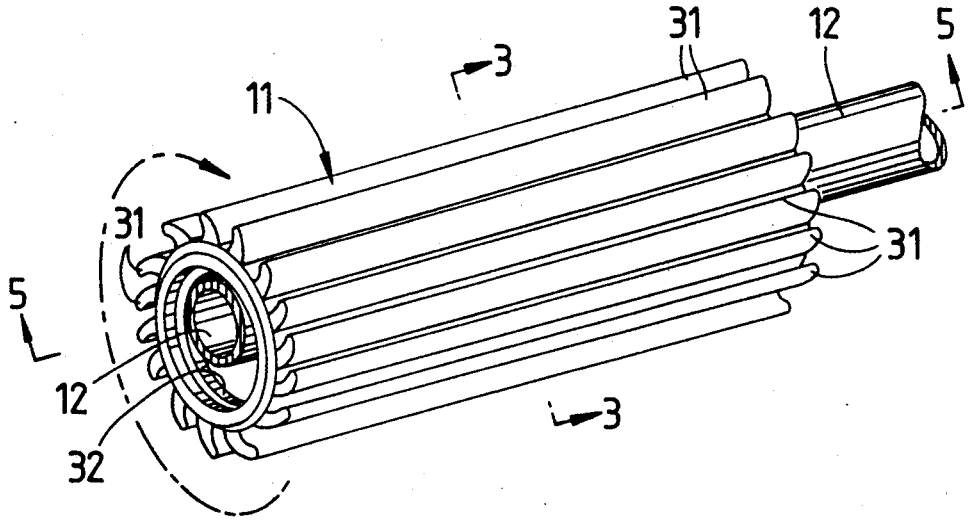
FIG. 2

FIG. 3
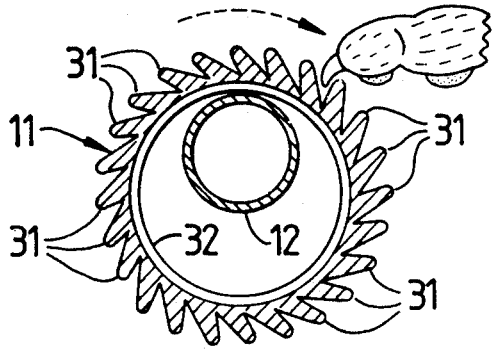
FIG. 4B
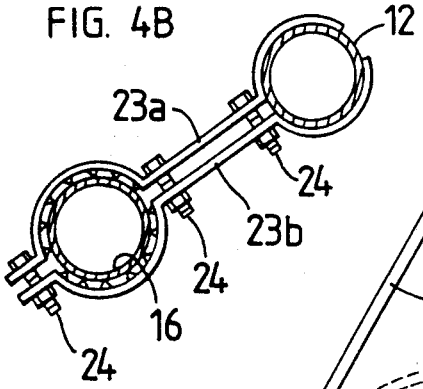
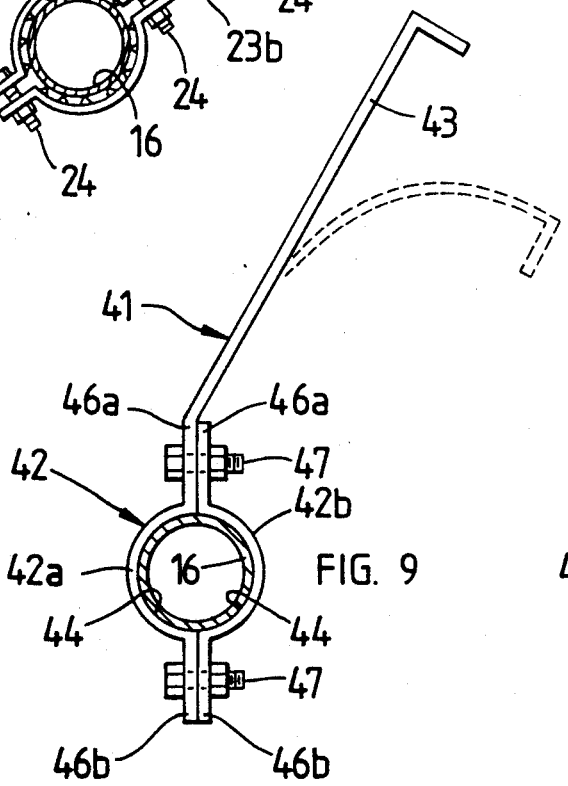
FIG. 9
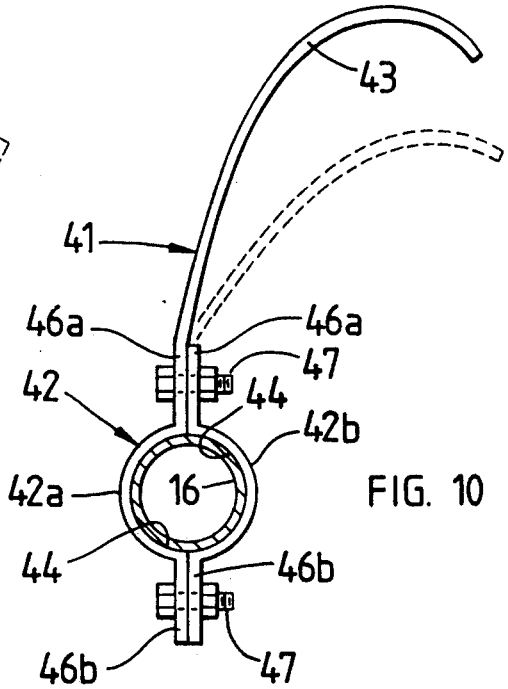
FIG. 10

ANIMAL RETENTIVE FENCE ATTACHMENT

FIELD OF THE INVENTION

The present invention relates to fences and cages and more particularly to wire mesh or chain link fences of the type used as a boundary to enclose an area to prevent dogs or other canines from crossing the boundary. More particularly the present invention relates to devices mounted at the top of a fence to prevent an animal from going over the fence. In even greater particularity the present invention relates to fence top barriers which prevent an animal from going over the fence and which do not injure the animal.

BACKGROUND OF THE INVENTION

Many dog owners utilize what are known as dog runs to provide an area for exercise of their dogs. This reduces the area of the owner's property which would otherwise be fenced in to prevent the animal's escape. Other owners merely fence in substantially all of their yard. Regardless of the space provided, however, the dog's natural instinct and inherent behavior requires the creature to seek a means to escape confinement and thus to roam at will. Accordingly, the dog will either go under or over the fence. There are numerous devices which can be used to prevent the dog from going under the fence, however, heretofore no device has been provided which prevents the dog from going over the fence. The natural solution would seem to be to build a higher fence, however, dogs do not merely high-jump fences. Some dogs are, in fact, combination jumper/-climbers. That is to say, they are agile enough to leap to the top of the fence and cling to the top rail or fence top with their forelimbs while using their rear feet to push against the fence and crawl over, to the dismay of numerous owners, pedestrians, and mailmen. Some dogs don't jump at all; they climb from the bottom as ascending a ladder and may be eviscerated on barbed or pointed ends of chain link fence. It should also be noted that many dogs are also injured due to falls in attempting this escape.

SUMMARY OF THE INVENTION

It is the object of the present invention to keep the clever canine confined.

Yet another object of the invention is to prevent injury to a dog who attempts to climb a high fence.

Still another object is to reduce the height needed to confine a canine.

A further object would be to provide a property owner with a fence topping to deter the entry or exit of a dog from the property.

Yet another object is to provide a generally decorative fence topping which achieves the foregoing objects.

These and other objects of my invention are advantageously accomplished by providing a fence topping which retains or returns to its normal shape yet which will not support the weight of a dog attempting to go from one side of the fence to the other. In one form my invention utilizes a plurality of rotatable members affixed superjacent the fence such that the weight of a dog supported thereon by its forelegs causes the member to rotate toward the dog thereby causing the dog to fall. In members extending upwardly and inwardly toward the dog's enclosure. These members bend downwardly under the dog's weight and cause him to fall.

BRIEF DESCRIPTION OF THE DRAWINGS

Apparatus embodying features of my invention are depicted in the accompanying drawings which form a portion of this disclosure and wherein:

FIG. 1 is a perspective view of one form of my invention atop a fence discouraging departure of a dog;

FIG. 2 is a perspective view of a segment of a roller used in my invention;

FIG. 3 is a sectional view taken along line 3—3 of FIG. 2;

FIG. 4*b* is a sectional view showing a third option for mounting the roller;

FIGS. 9 and 10 are side views of two embodiments of the segment shown in FIG. 8.

DESCRIPTION OF THE PREFERRED EMBODIMENTS

Referring to the Figures for a clearer understanding of my invention, it may be seen in FIG. 1 that my invention is an auxiliary device which mounts atop the existing fence structure or may be included in the new erection of a fence.

Figure 4A:
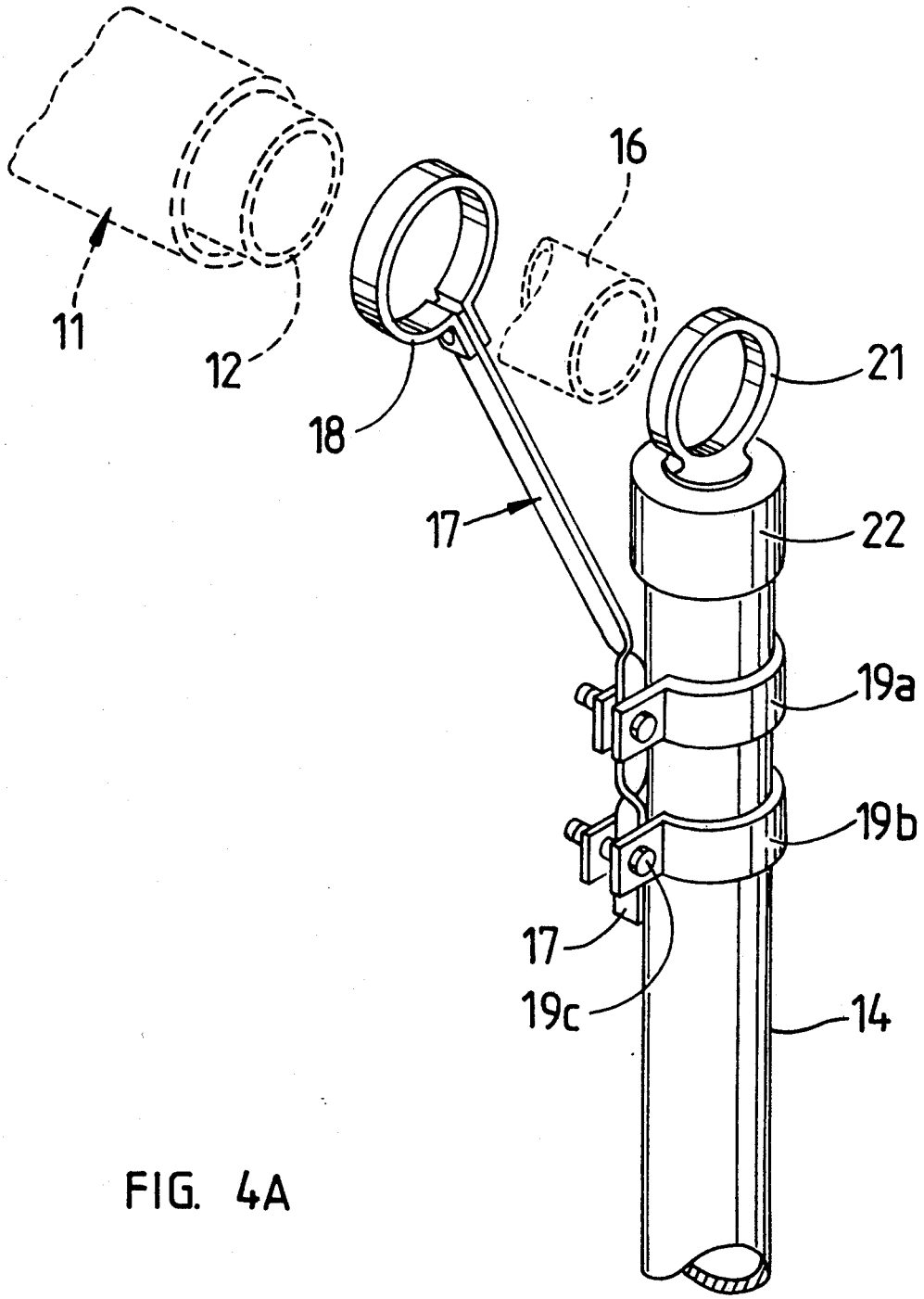
FIG. 4*a* is a perspective view showing two options for mounting my invention to a fence post.

The embodiment shown in FIG. 1 utilizes a plurality of roller elements 11, having a predetermined inside diameter such that they loosely fit around a support rod !2 which is supported above the height of an associated fence 13. The fence 13 includes support posts 14 and horizontal support tubes or top rails 16 to which a fabric or mesh, such as chain link, is tied. The rod 12 is supported by a plurality of arms 17 which are shown more clearly in FIG. 4*a*. As may be seen in FIG. 4*a*, each arm 17 has attached to its uppermost end an "O" clamp 18 through which rod 12 is received. The lower end of the arm 17 has bolted thereto a pair of "O" clamps 19*a* and 19*b* which are secured to post 14. The arm 17 has a 90 twist formed therein adjacent the upper "O" clamp 19*a* and is bent outwardly from post 14. The arm 17 is also twisted intermediate "O" clamps 19*a* and 19*b* to rest flat against the bolt 19*c* of "O" clamp 19*b*. Thus the arm 17 forms a stabilized spring support for the rod 12 and rollers 11. Also shown in FIG. 4*a* is an alternative support ring 21 affixed to a cap 22 on post 14. If ring 21 is used it must be positioned at a height to insure that rollers 11 do not contact the rail 16 of the fence 13 at any point. Referring to FIG. 4*b*, a third support is disclosed for rod 12. In this embodiment a mated pair of clamp members 23*a* and *b* are formed with concave end portions adapted to partially encircle rail 16 and rod 12. The clamp members 23*a* and *b* are secured by threaded fastener 24. This embodiment provides stand-off between the roller 11 and the rail 16 and provides an appearance similar to arms 17.

Referring to FIGS. 2 and 3, it may be seen that the rollers 11 are preferentially formed of a plastic or metal material with a plurality of outwardly extending splines 31 formed on the outer surface thereof. As seen most clearly in FIG. 3 the splines 31 are inclined counter to the direction of intended rotation of the roller such that they would cause the intended rotation if engaged by the dog.

Figure 5:
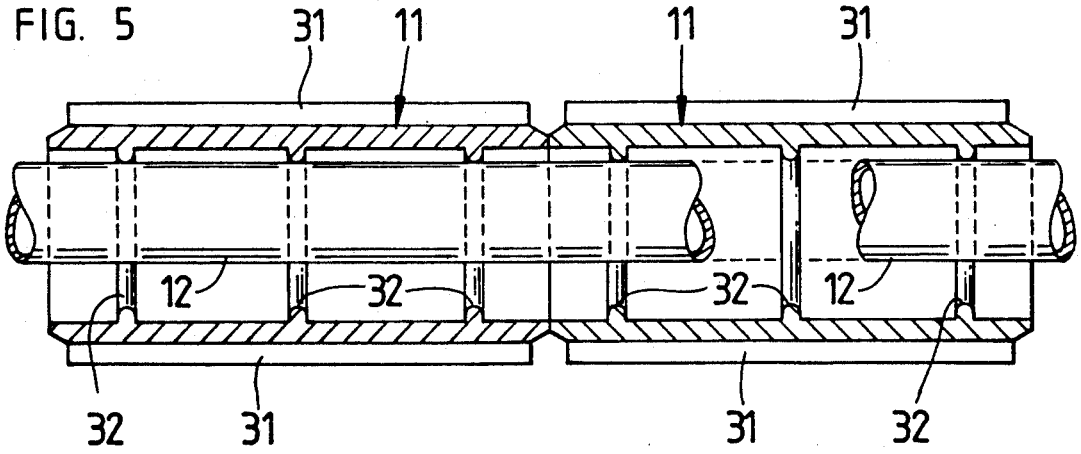
FIG. 5 is a sectional view taken along line 5—5 of FIG. 2.

In FIG. 5, it may be seen that the rollers 11 are formed with internal annular ridges 32 which contact rod 12. These ridges hold the inner surface of the rollers 11 out of contact with the rod 12 and provide minimal surface contact with the rod 12 such that the rollers 11 are easily rotated by the animal. Also, note that the ends of the rollers are beveled to provide minimal roller to roller contact to reduce friction therebetween.

Figure 6:
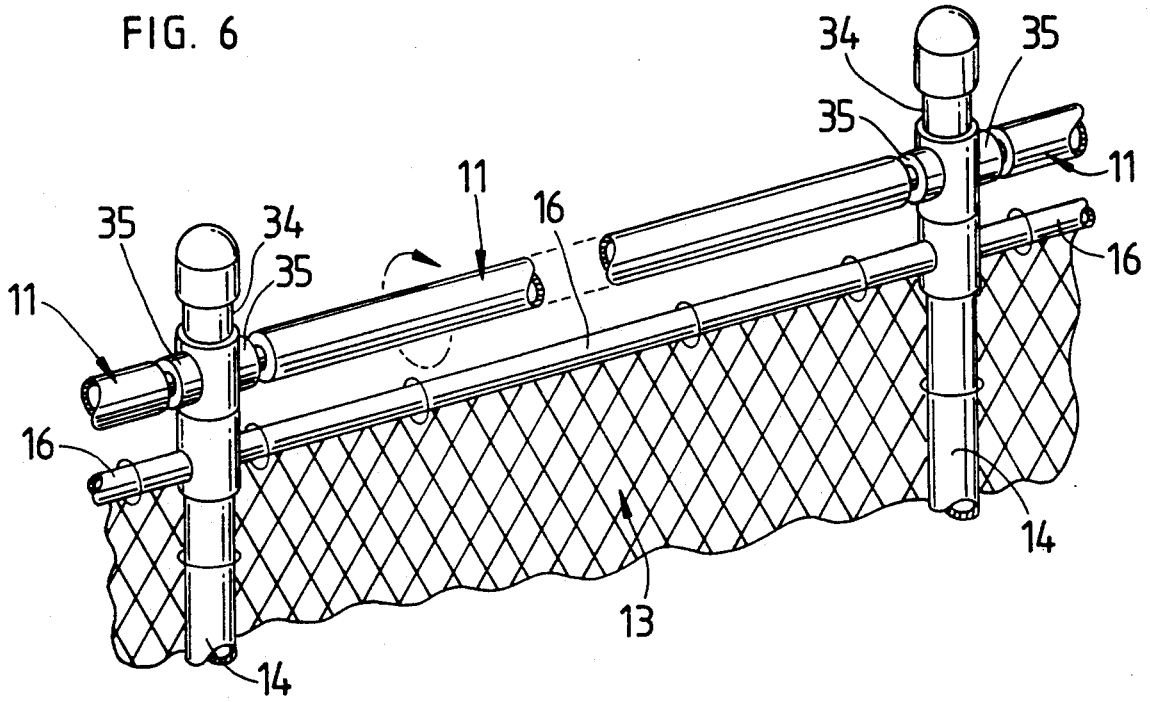
FIG. 6 is a perspective view of yet another embodiment.

Yet another alternative is shown in FIG. 6 wherein the roller 11 extends from post to post above the rail 16 and is mounted on post extension 34 which has a lubricated bearing 35 affixed thereto for mating engagement with the rollers 11. As will be understood the rollers shown in this more elaborate system would be preferred in a fence installation setting as opposed to altering an existing fence where the posts 14 might not be evenly spaced.

Figure 7:
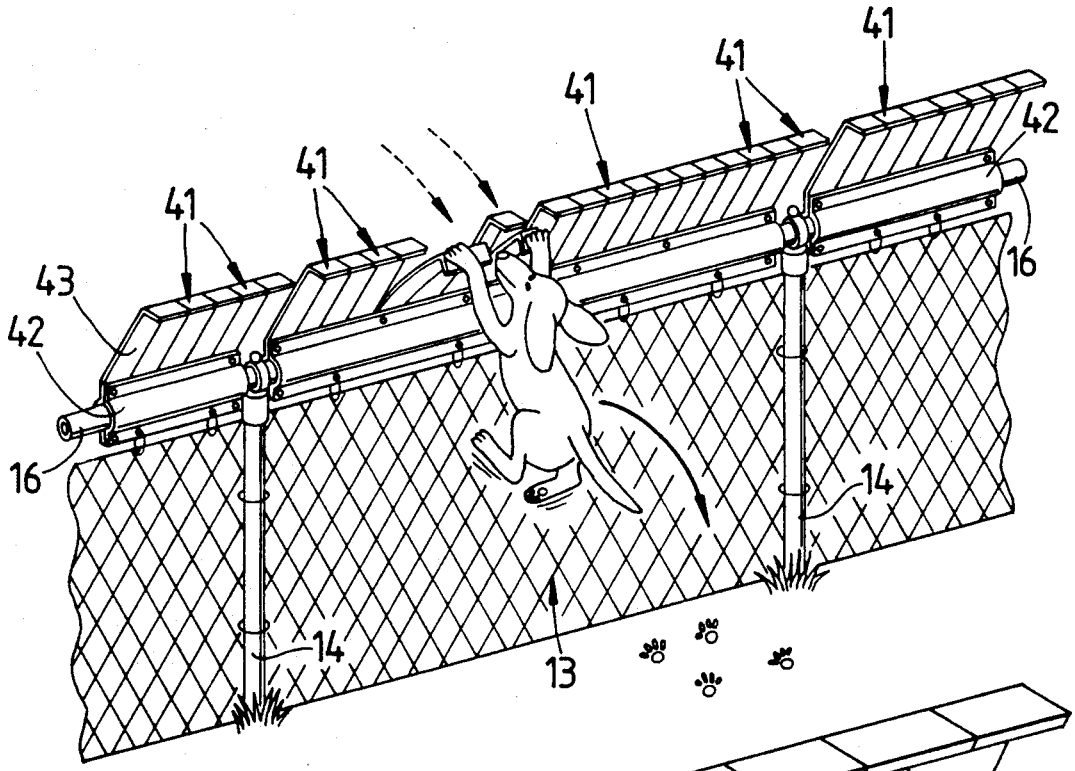
FIG. 7 is a perspective view of another embodiment of the invention keeping a canine confined.

In FIG. 7 I depict yet another embodiment of my invention. In this embodiment a set of flexible members 41 are affixed to the rail 16 of the fence and extend upwardly and inwardly on the dog's side of the fence. As seen more clearly in FIG. 8, the flexible members have a lower rail-engaging portion 42 and an upper flexible portion 43. The lower portion 42 is formed in two halves 42*a* and 42*b* with 42*a* being integrally formed with upper portion 43. Each of 42*a* and 42*b* include a semi-cylindrical portion 44 or housing which fits about rail and an upper and lower flange portion 46*a* and 46*b* which are connected by threaded fasteners 47. A set of apertures 48 accommodate a set of fence engaging loops 49. In this embodiment the flexible members may be clamped directly to the rail 16 and the fence may be supported by the loops 49 passing through the lower flange portion 46*b* and the top of the fence fabric as shown in FIG. 7 the lower portions, or the rail 13 may be raised and the fabric 17 supported by loops 49 or they may be lowered by cutting off one X-section of the fence and engaged with loops 49.

FIGS. 9 and 10 illustrate the displacement of upper portion 43 which is shown in two different profiles, either of which are acceptable. The flexible member is made of a durable plastic material with sufficient rigidity to support itself in the manner shown in solid line yet flexible enough to bend to the position shown in dotted line without permanent deformation of the member. That is to say, the flexible member 41 should return to its generally upright position after each downward deflection.

Figure 8:
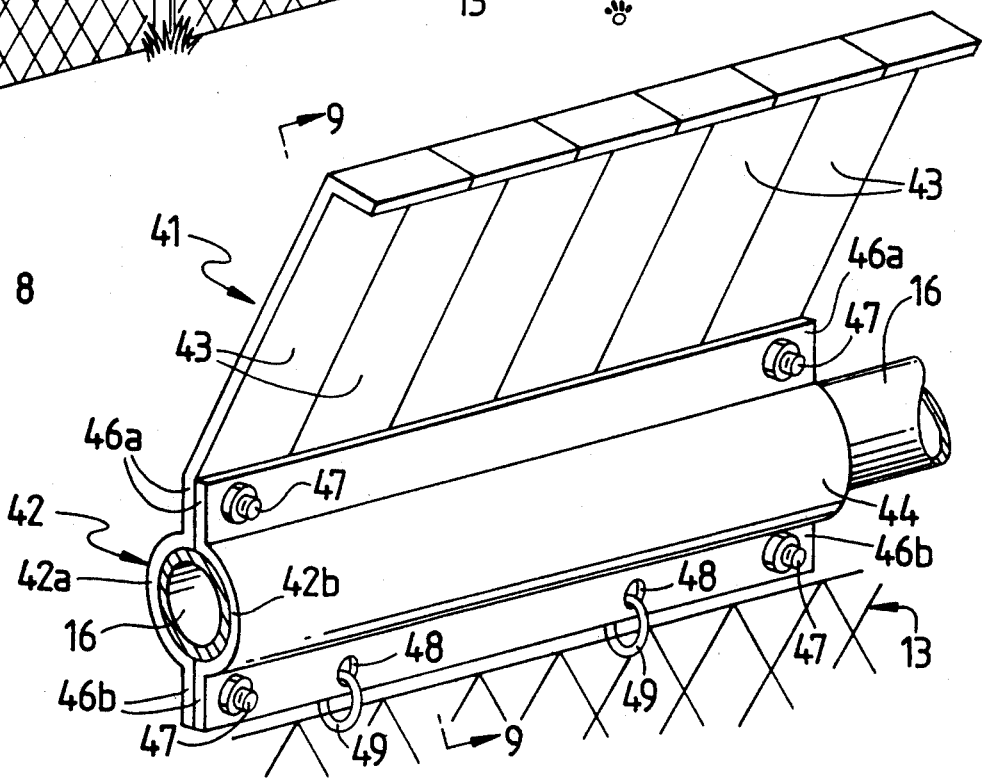
FIG. 8 is a perspective view of a segment of the embodiment shown in FIG. 7.

In operation, with the embodiments of FIGS. 8–10 installed on a fence the flexible members will be perceived by the dog as the top of the fence, thus a dog jumping to the top of the fence will attempt to place his weight on his forelegs on the member 41. Obviously, these members 41 will deflect downwardly under the weight of the dog and he will be unable either to climb the fence by clinging to the top or to propel himself over the fence by pushing on the top and will fall harmlessly to the ground.

In the embodiments of FIGS. 1–7 the same effect is achieved by the rollers which rotate toward the dog when he puts his weight thereon after leaping or climbing to the top of the roller. The rotation of the roller prevents the dog from supporting his weight on the rail and thus the dog immediately falls.

From the foregoing it may be seen that my invention will prevent injury to the dogs by repelling them from the fence top before they are able to engage their limbs in the fence fabric or fall from balancing on the top rail or eviscerating themselves on the mesh or entangling their paws and thus become entangled. Thus, not only are the dogs retained in their confinement, they are also protected from injury during their escape attempts. It is also noteworthy to mention that my invention enables dog owners to build their fences to a substantially lower height without fear of the dog escaping.

While I have shown my invention in various forms, it will be obvious to those skilled in the art that it is not so limited but is susceptible of various changes and modifications without departing from the spirit thereof.

What I claim is:

1. Apparatus for preventing an animal from transversing a fence at the top thereof comprising:
   (a) means for providing a region of instability proximal said top of said fence comprising a plurality of flexible members extending upwardly and outwardly from said fence with each one of said plurality of flexible members in lateral abutting relationship with at least one adjacent flexible member to form a substantially continuous row of said flexible members along the top of said fence; and
   (b) means for rigidly affixing said plurality of flexible members to said fence such that each of said plurality of flexible members is prevented from rotation about a horizontal axis.

2. Apparatus as defined in claim 1 wherein said means for rigidly affixing comprises:
   (a) a housing in two halves with a portion of said halves formed in a concave manner for positioning on each side of a horizontal support tube of said fence;
   (b) wherein one half of said housing extends above and from apex of said fence with said plurality of flexible members; and
   (c) a means for fastening said halves about said tubing.

3. Apparatus as defined in claim 2 wherein a series of rigid fasteners are placed through aligned holes in said halves and tightened to secure said halves of said housing to said tubing.

4. Apparatus as defined in claim 2 in said housing supports fence with a series of ring fasteners connected therebetween.

5. Apparatus as defined in claim 1 wherein said plurality of flexible members are formed from plastic.

6. Apparatus as defined in claim 1 wherein said flexible members are formed from a resilient metal.

* * * * *